United States Patent [19]

Trewhella

[11] Patent Number: 4,535,917

[45] Date of Patent: Aug. 20, 1985

[54] DISPENSING APPARATUS

[75] Inventor: Joseph M. Trewhella, Godfrey, Ill.

[73] Assignee: Multiplex Company, Inc., St. Louis, Mo.

[21] Appl. No.: 399,197

[22] Filed: Jul. 16, 1982

Related U.S. Application Data

[63] Continuation-in-part of Ser. No. 234,350, Feb. 13, 1981, abandoned.

[51] Int. Cl.[3] ..... B67D 5/56

[52] U.S. Cl. ..... 222/129.1; 222/318; 222/146.6; 137/599; 137/563

[58] Field of Search ..... 222/129.1–129.4, 222/146, 146 L, 318, 129, 424, 504; 141/45; 137/599, 563

[56] References Cited

U.S. PATENT DOCUMENTS

| | | | |
|---|---|---|---|
| 2,401,124 | 2/1944 | Walker et al. | 141/37 |
| 3,200,833 | 8/1965 | McColl | 137/154 |
| 3,529,626 | 9/1970 | German | 137/563 |
| 4,037,567 | 7/1977 | Torres | 137/563 X |
| 4,042,151 | 8/1977 | Uttech | 222/129.2 |
| 4,124,045 | 11/1978 | Slywka | 222/318 X |
| 4,226,344 | 10/1980 | Booth et al. | 222/504 |
| 4,270,673 | 6/1981 | Rodth | 222/146 C X |

*Primary Examiner*—Joseph J. Rolla
*Assistant Examiner*—Kevin P. Shaver
*Attorney, Agent, or Firm*—Senniger, Powers, Leavitt and Roedel

[57] ABSTRACT

Apparatus for dispensing cold drinks comprising a cold water supply line in which cold water is flowing continuously, a valve comprising a valve body having passaging, an inlet for delivery of cold water from a first point along said supply line to the passaging, a main outlet for dispensing of cold water from the passaging, a valve member for the main outlet, and an auxiliary outlet for return of cold water from the passaging to a second point along the supply line downstream from the first point, and a Venturi in the supply line for causing a pressure differential in the cold water between the first and second points along the supply line for continuous flow of the cold water from the supply line through the passaging and the auxiliary outlet back to the supply line when the valve member is closed, thereby to assure having cold water on tap in the passaging for being dispensed when the valve member is opened. In a second embodiment the valve body has a syrup passage for flow of syrup to the main outlet and a syrup valve, the syrup passage being in heat-exchange relation with the continuously flowing cold water.

10 Claims, 11 Drawing Figures

DISPENSING APPARATUS

CROSS REFERENCE TO RELATED APPLICATION

This is a continuation-in-part of my co-pending application Ser. No. 234,350, filed Feb. 13, 1981, now abandoned.

BACKGROUND OF THE INVENTION

This invention relates to dispensing apparatus, and more particularly to apparatus for dispensing cold drinks such as carbonated beverages.

Dispensers for cold drinks such as carbonated beverages are typically subject to an ambient temperature substantially above the supply line temperature of the water supplied for the mixing of the drinks (e.g., 30°-50° above the supply line temperature of the water), and thus may be warmed to a temperature above the supply line temperature of the water. A problem with prior art dispensers has been that during each time interval between the dispensing of drinks, a quantity of the water is held or retained in the dispenser and may absorb heat from the dispenser (noting that the dispenser absorbs heat from the ambient atmosphere). If the time interval is relatively long, the quantity of water held in the dispenser may be warmed to a temperature at which $CO_2$ gas is released from the water. A dispensed drink may therefore be "flat" and warm, and thus unsatisfactory.

SUMMARY OF THE INVENTION

Among the several objects of this invention may be noted the provision of apparatus for dispensing cold drinks in which cold water, e.g., carbonated water, is supplied from a line through which the water is continuously flowing, in which the water for a drink is dispensed at a temperature at, or near, its supply line temperature regardless of the time interval between the dispensing of drinks, thus preventing the dispensing of warm drinks and "flat" drinks; the provision of such apparatus which does not hold or retain a fixed quantity of water therein during the time interval between the dispensing of drinks; the provision of such apparatus in which syrup for drinks is cooled by the flow of the cold water through the apparatus; and the provision of such apparatus which is of simplified construction to facilitate quicker and easier cleaning and repair.

In general, dispensing apparatus of this invention comprises a line for supplying cold water for drinks adapted for continuous flow of water therethrough, and a valve for dispensing water from said supply line. The valve comprises a valve body having an inlet interconnected with said line at a first point along said line, an outlet for delivery of water from the valve body into a cup, a delivery passage in the body for delivery of water from the inlet to the outlet, a valve seat in the body adjacent the outlet, and a valve member associated with the body movable between a closed position engaging the seat blocking flow of water through the outlet and an open position for flow of water through the outlet. A system is provided for maintaining a continuous flow of the cold water through said delivery passage and back to said line when the valve member is closed to assure having cold water on tap for being dispensed when the valve member is opened, comprising a return passage in the valve body interconnected with the delivery passage downstream from the inlet and upstream from but adjacent the valve seat and a return connection from said return passage to said supply line at a second point along said line downstream from said first point, and means for causing a pressure differential in the water between said first and second points such that, when the valve member is closed, cold water flows continuously from said first point along said line to the inlet, through said delivery passage, through said return passage and through said return connection back to the line at said second point along said line.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
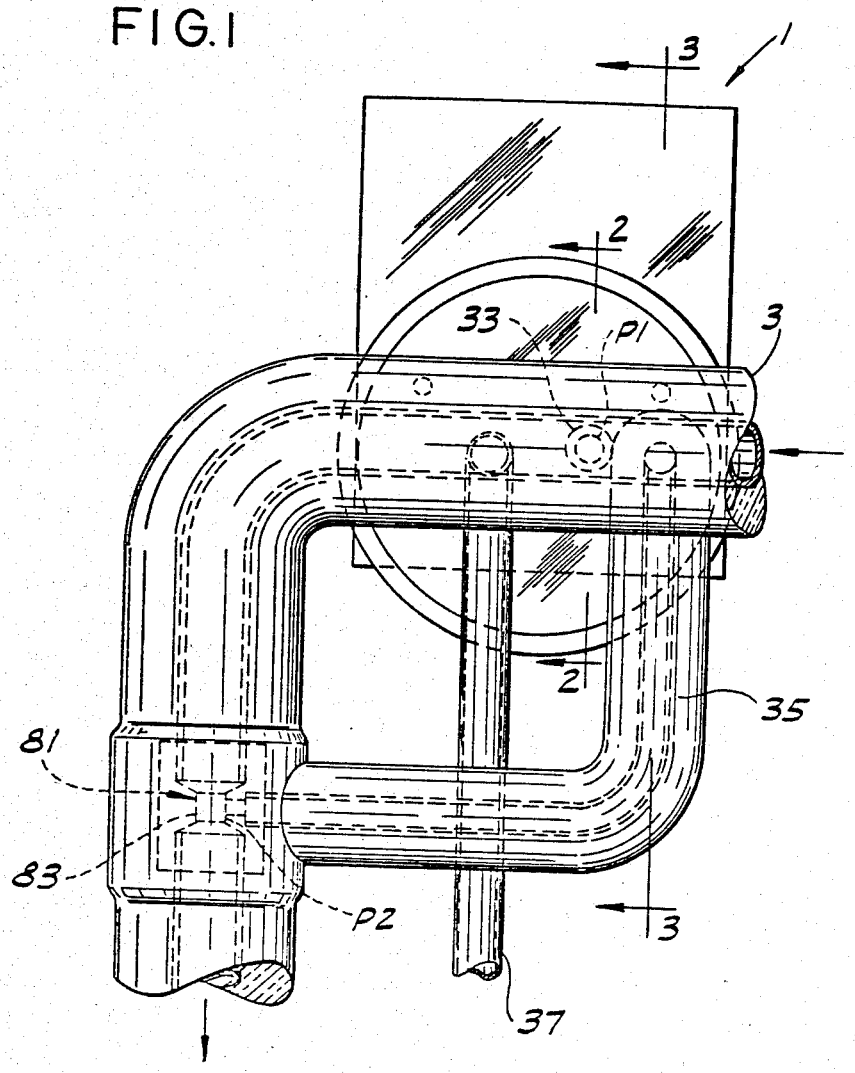
FIG. 1 is an end elevation of dispensing apparatus of this invention showing a segment of a cold water supply line, a wall structure upon which the apparatus is mounted being omitted for clarity.

Referring to the drawings there is generally indicated at 1 apparatus of this invention for dispensing cold liquid, such as carbonated water for post-mixed cold drinks, from an insulated supply line 3 in which the liquid is under pressure and flowing continuously. The dispensing apparatus 1 comprises a valve 5 having a valve body or block 7 of two-part construction and a cover 8 for the valve block, the first or inner portion 9 of the valve block being mounted on a wall 11 of a cabinet or the like by conventional fasteners 13, the second or outer portion 15 being detachably secured to the inner portion 9 by suitable fastening means such as a threaded coupling ring 17.

Figure 2:
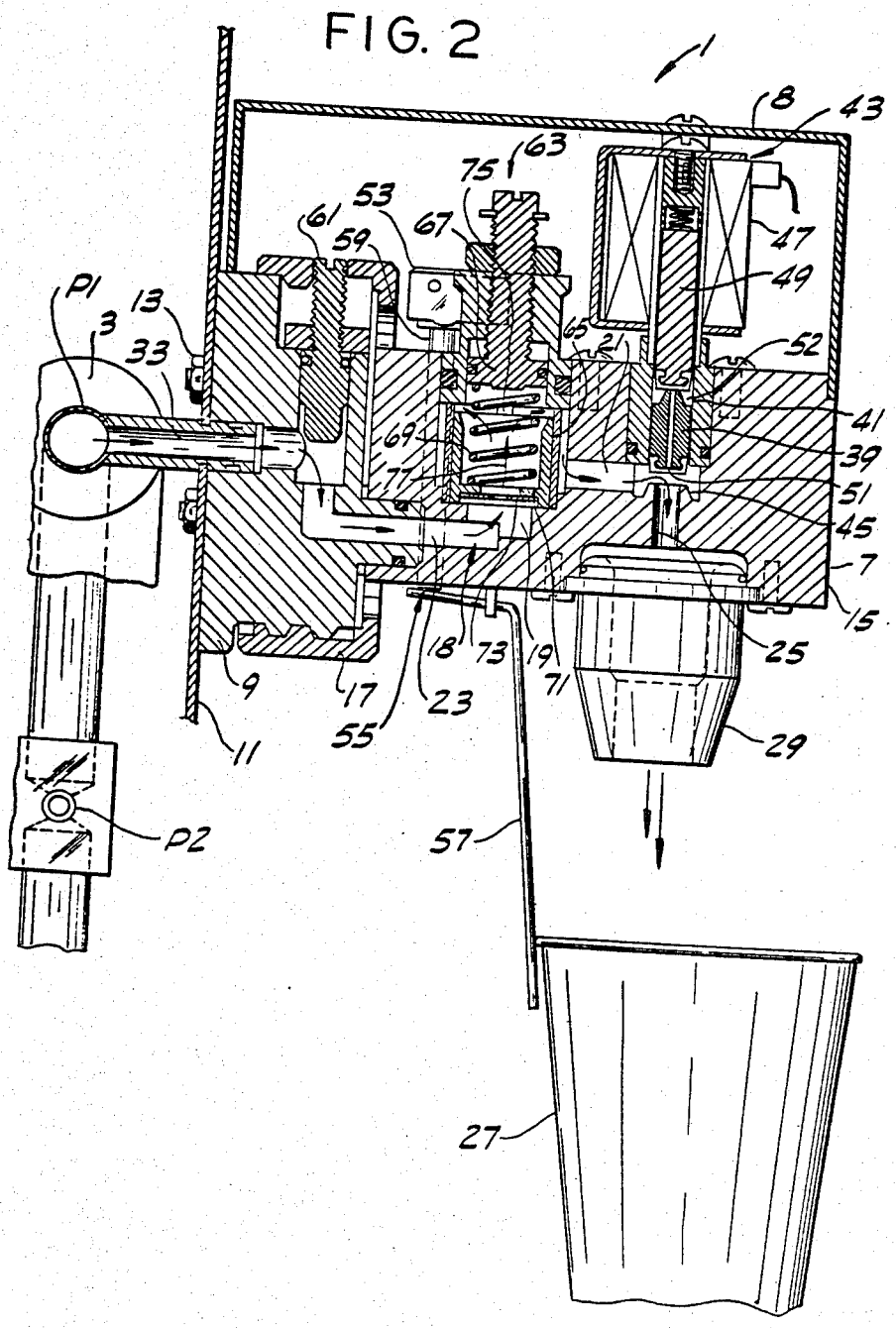
FIG. 2 is a section on line 2—2 of FIG. 1 showing the flow path of water through the valve when the valve is open for dispensing.
Figure 3:
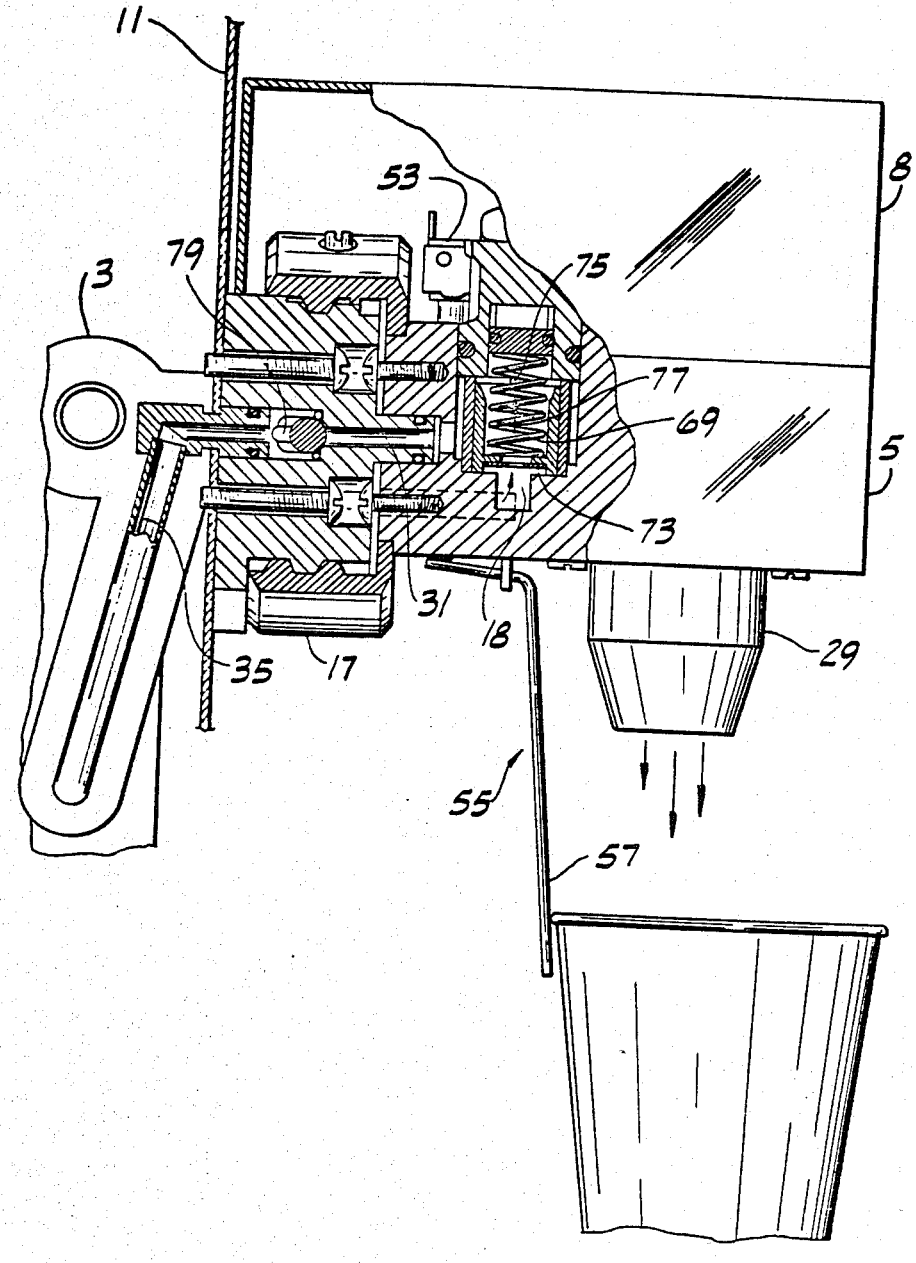
FIG. 3 is a section on line 3—3 of FIG. 1 showing an auxiliary outlet of the valve having a check valve therein for blocking flow of water therethrough when dispensing.
Figure 4:
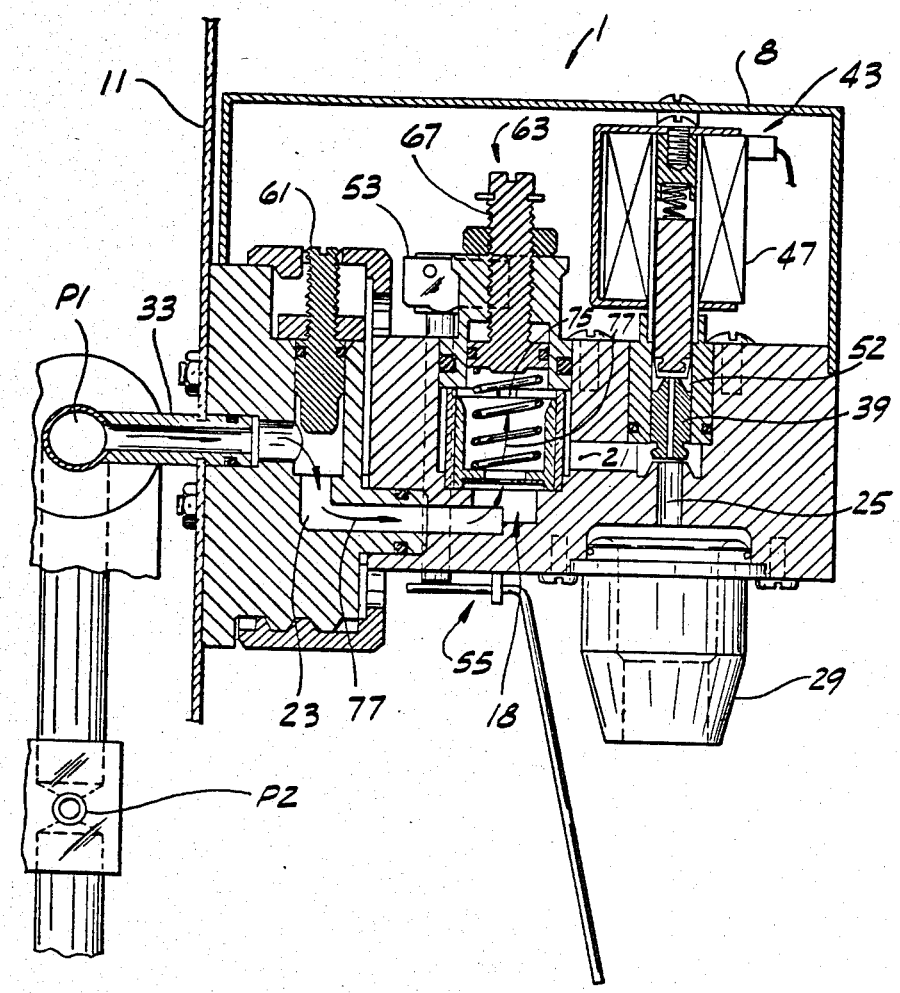
FIG. 4 is a section similar to FIG. 2 showing the flow path of water into the valve when the valve is closed.
Figure 5:
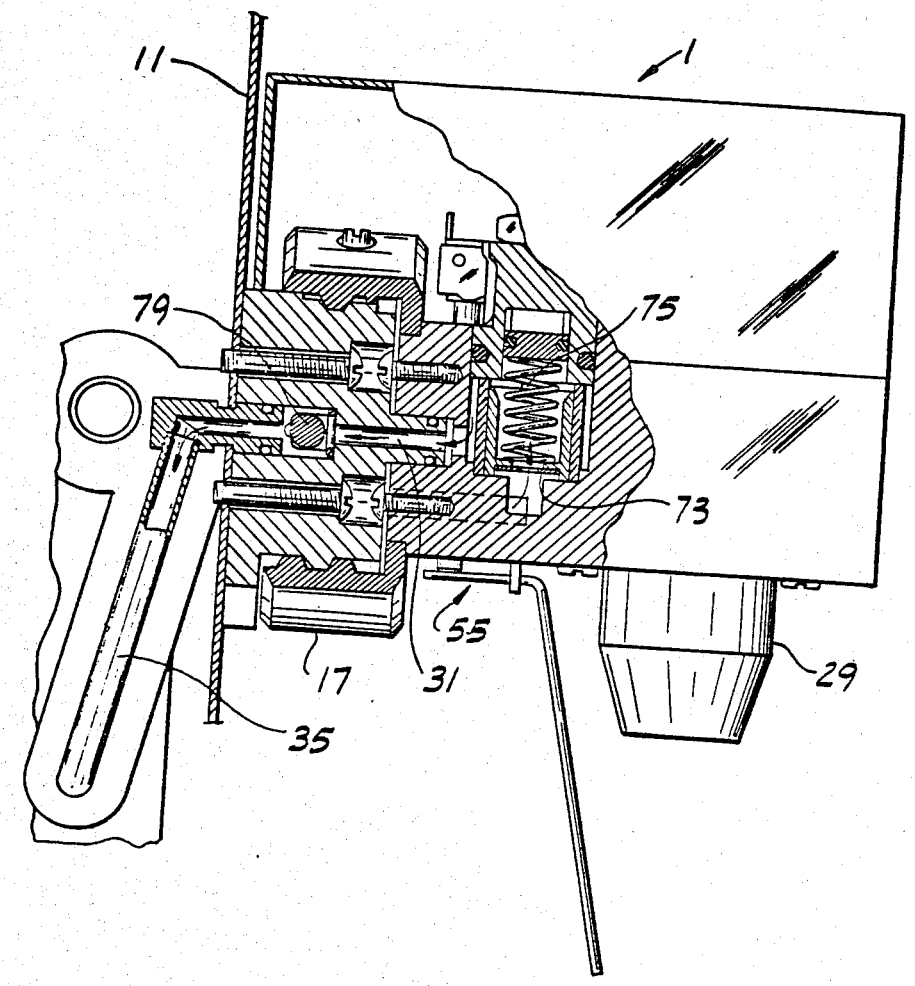
FIG. 5 is a section similar to FIG. 3 showing the flow path of liquid out of the valve when the valve is closed.
Figure 6:
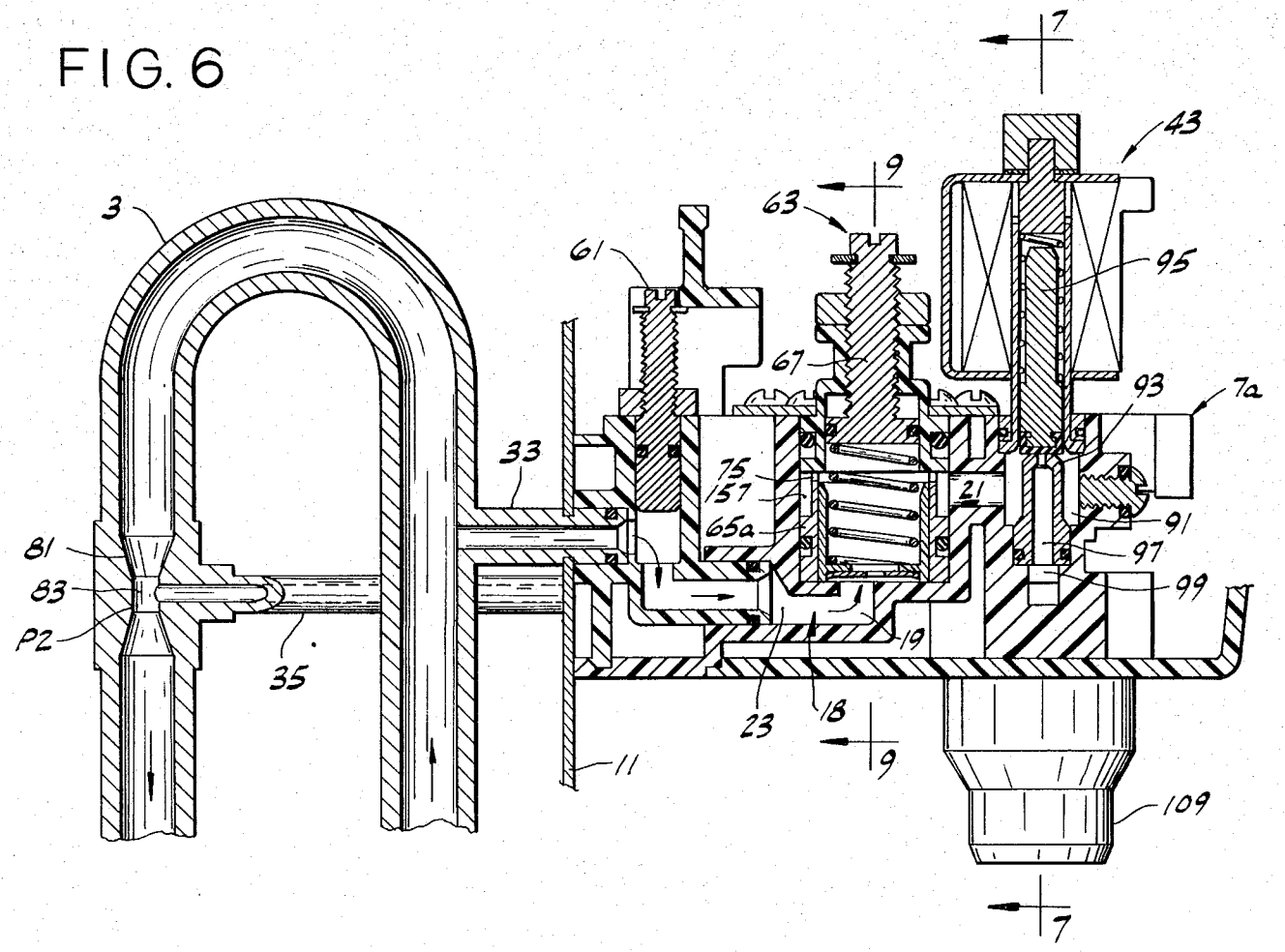
FIG. 6 is a view similar to FIG. 1 showing a modification.
Figure 7:
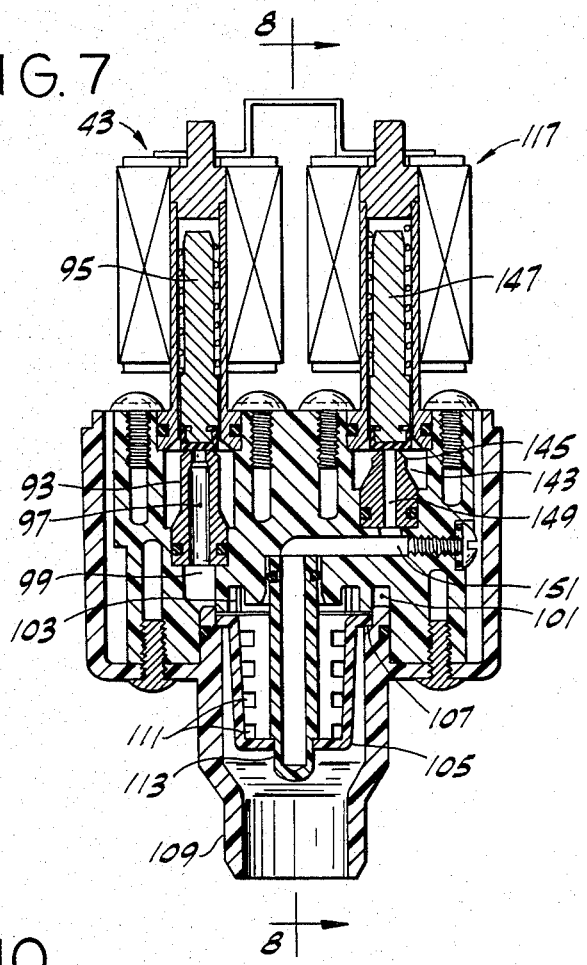
FIG. 7 is a section on line 7—7 of FIG. 6.
Figure 10:
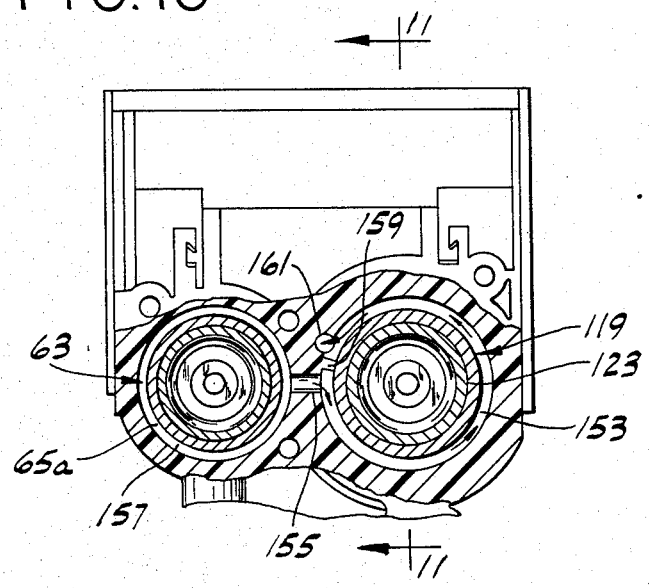
FIG. 10 is a horizontal section on line 10—10 of FIG. 9 with parts broken away.
Figure 8:
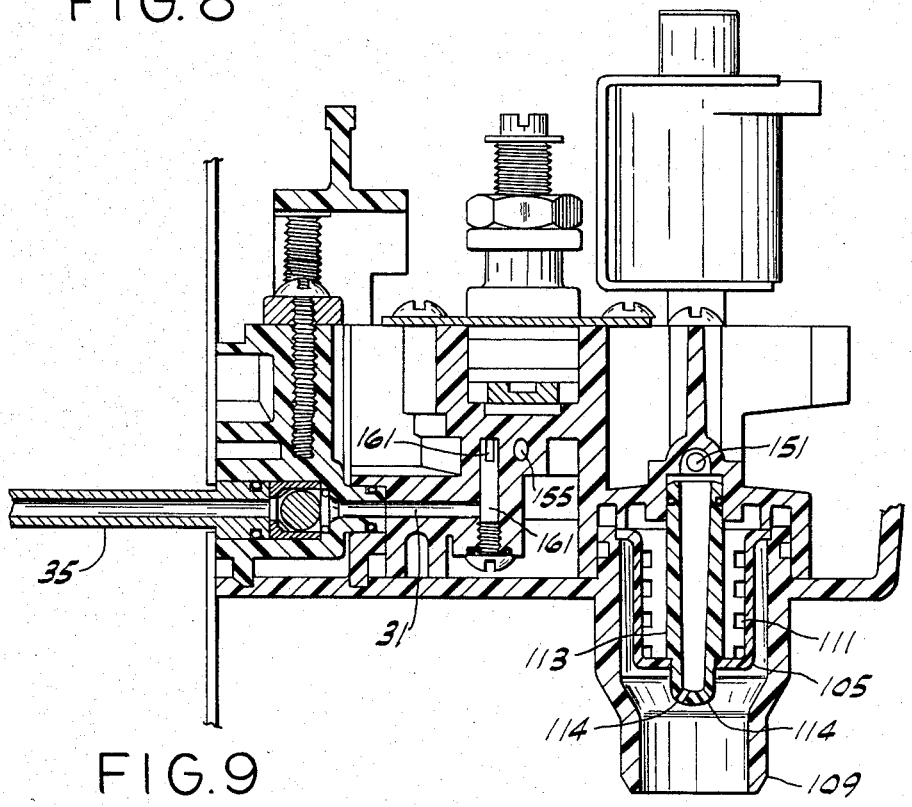
FIG. 8 is a section on line 8—8 of FIG. 7.
Figure 9:
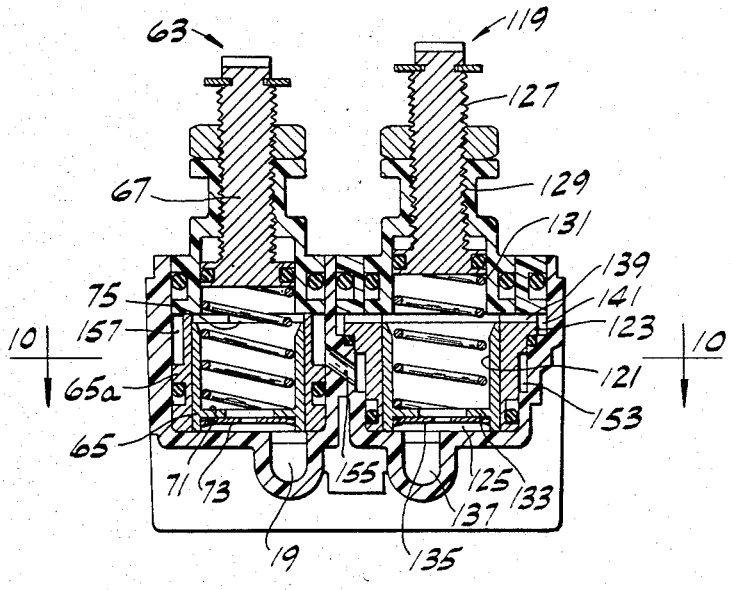
FIG. 9 is a section on line 9—9 of FIG. 6.
Figure 11:
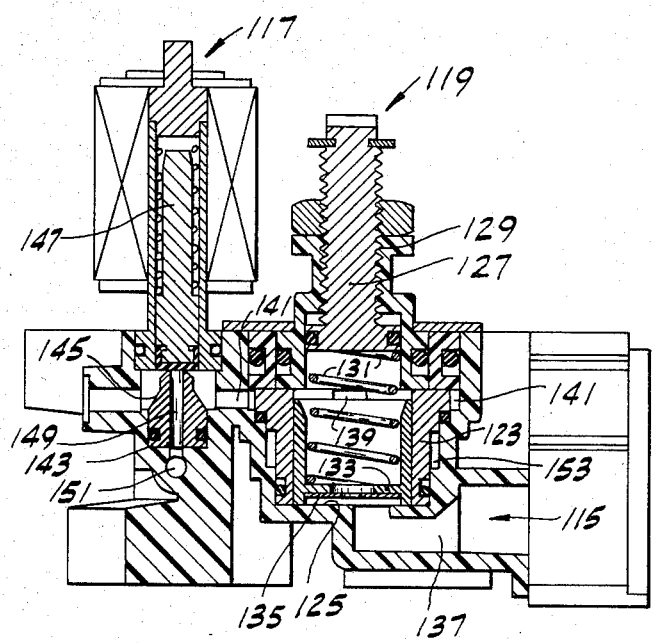
FIG. 11 is a vertical section on line 11—11 of FIG. 10.

As shown in FIGS. 2 and 4, the valve block 7 is drilled to provide passaging generally indicated at 18 therein comprising a generally cylindrical chamber 19, a port 21 extending laterally from the chamber, an inlet passage 23 for flow of liquid from the supply line to the passaging, and a vertically extending main outlet passage 25 receiving liquid from the port 21, when the valve 5 is open, for dispensing the liquid into a receptacle such as a cup 27 beneath the main outlet via an outlet nozzle 29 detachably secured to the underside of the valve block. In addition, the valve block 7 is drilled as shown in FIGS. 3 and 5 to provide an auxiliary outlet passage 31 for return of liquid from the passaging 18 to the supply line 3 when the valve 5 is closed.

An inlet conduit 33 from a first point P1 along the supply line 3 is connected to the inlet 23 for flow of liquid into the valve. An outlet conduit 35 is provided connecting the auxiliary outlet 31 and a second point P2 along the supply line 3 downstream of the first point P1 for flow of liquid out of the valve when closed. For postmix purposes a conduit 37 connected to a supply of syrup (not shown in FIGS. 1-5) is provided, and the valve block 7 is drilled to provide a passage (not shown in FIGS. 1-5) for flow of syrup through the valve.

The valve 5 further comprises a valve member 39 movable in a bore 41 in the valve block in axial alignment with the main outlet 25, and means generally indicated at 43 for moving the valve member in the bore 41 between a lowered position in which it engages the end of a tubular projection 45 constituting a valve seat at the upper end of the main outlet 25 to close the main outlet and a raised position away from the valve seat to open the main outlet. The moving means 43 comprises a solenoid 47 mounted on the valve block above the bore 41, the plunger 49 of the solenoid being spring biased down in the bore 41 into engagement with the upper end of the movable valve member 39. The valve member is movable upwardly in the bore upon energization of the solenoid, the pressurized liquid in the port 21 lifting the valve member 39 up in the bore 41 when the plunger 49 is raised. Extending the length of the valve member is a hole 51 of relatively small diameter providing communication between the space 52 above the plunger 39 and the outlet 25 for discharge of liquid from the space 52 upon the downstroke of the plunger from its raised position. The moving means 43 further comprises a control switch 53 for the solenoid 47 and a linkage generally indicated at 55 for actuating the switch when the cup 27 is placed in position to receive liquid from the main outlet. The linkage 55 comprises a lever 57 pivotally mounted on the underside of the valve block 7 having a first arm adapted to be engaged by the cup 27 and a second arm engageable with the lower end of a rod 59 slidably mounted in a bore in the valve block, the upper end of the rod 59 being engageable with the switch 53 when the rod is raised by the lever 57.

As shown in FIGS. 2 and 4, the valve 5 further includes a second valve member 61 threaded in the inner portion 9 of the valve block and movable to a position blocking the flow of liquid through the inlet passage 23 to enable the outer portion 15 of the valve block to be detached for cleaning and repair of the valve. In addition, flow control means generally indicated at 63 is provided comprising a pair of tubular members 65 in telescoping relation with each other in the chamber 19, a plunger 67 threaded in the valve block, and a spring 69 between the plunger and an upper face of an inner flange 71 of the inner tubular member, the inner tubular member carrying a ported disc 73 at the lower face of the flange, the outer tubular member having an opening 75 adjacent its upper end. With the pressure of the liquid in the inlet 23 lower than that in the chamber 19, liquid flows as indicated by the arrows 77 in FIGS. 2-5 from the inlet 23 up through the chamber 19 via the ported disc 73 and the opening 75 to the annular space around the outer tubular member. With the pressure of the liquid in the inlet 23 greater than that in the chamber 19, the inner tubular member moves up within the outer member to close the opening 75. The flow control means 63 thus regulates the pressure as well as the flow rate of the liquid through the valve 5. As shown in FIGS. 3 and 5, the valve 5 further comprises a check valve 79 in the auxiliary outlet 31 to prevent flow of liquid from the supply line 3 through the auxiliary outlet 31 to the chamber 19 when the valve 5 is open and liquid is being dispensed, as more fully described hereinafter.

In accordance with this invention, the dispensing apparatus 1 further comprises means, generally indicated at 81, for causing a pressure differential in the liquid between the points P1 and P2 along the supply line 3 for continuous flow of liquid from the supply line through the chamber 19 when the valve member 39 is in closed position thereby to assure having cold liquid on tap in the chamber 19 for being dispensed when the valve is opened. Moreover, the flow of cold liquid in the chamber 19 past the mouth of the port 21 causes circulation of cold liquid in the port 21 so that all liquid in the passaging 18 in the valve block 7 is maintained at or near its temperature when in the supply line regardless of the time interval between the dispensing of drinks. This in contrast to prior art dispensing apparatus in which a fixed quantity of liquid is held or retained in the passaging in the valve block during the time interval between the dispensing of drinks and allowed to warm to a temperature at which $CO_2$ is released from the liquid thereby resulting in the dispensing of a drink that is warm and "flat".

The means 81 for causing a pressure differential comprises a Venturi tube 83 in the supply line 3, the throat of the Venturi tube constituting the stated point P2 along the supply line. It is contemplated that the means for causing a pressure differential may alternatively comprise a flow restrictor such as a ported member (not shown) in the supply line 3 between the first and second points P1 and P2 along the supply line.

In the use of the dispensing apparatus of this invention, with the valve member 39 in closed position, the cold liquid flows from point P1 to point P2 along the supply line 3, a portion of the liquid flowing through the section of supply line 3 between points P1 and P2 and the remainder of the liquid flowing through the valve 5. As the portion of liquid flowing through the section of supply line between points P1 and P2 flows through the Venturi tube 83, the pressure of the liquid is reduced in the throat of the tube (i.e., at point P2) below the pressure of the liquid at point P1 along the supply line 3. This pressure differential between points P1 and P2 causes the remainder of the liquid to flow through the valve via the conduit 33, the inlet 23, the chamber 19, the auxiliary outlet 31 and the conduit 35.

To dispense a drink from the dispensing apparatus 1, a cup 27 is positioned under the nozzle 29 in engagement with the lever 57 thereby pivoting the lever and raising the rod 59 to actuate the switch 53. The switch, upon being actuated, energizes the solenoid 47 to raise the plunger 49 for allowing the valve member 39 to be lifted to open position. With the valve member in open position, cold liquid flows through the valve 5 to the cup from the supply line 3 via conduit 33, inlet 23, chamber 19, port 21, outlet 25, and nozzle 29, the pressure and flow rate of the liquid being controlled by the control means 63. Upon flow of liquid toward the cup 27, the pressure of the liquid in the chamber 19 drops below that in the auxiliary outlet 31 causing the check valve 79 to close thus preventing flow of liquid from the auxiliary outlet 31 to the chamber 19. After the cup has been filled to the desired level, the cup is moved out of engagement with the lever 57 to deenergize the solenoid 47. Upon deenergization of the solenoid, the valve member 39 is moved down by the plunger 49 to its closed position for blocking flow of liquid through the main outlet 25.

While the dispensing apparatus of this invention has been described as being utilized for dispensing carbonated drinks, it is contemplated that it could also be used for dispensing cold non-carbonated drinks, in which case the liquid flowing through line 3 is cold tap water.

FIGS. 6–11 illustrate a modification wherein the valve body, designated *7a,* has a syrup passage for flow of syrup from a syrup supply to the outlet of the valve for mixing with the cold water flowing through the outlet, and a syrup valve for the syrup passage with the syrup passage in heat-exchange relation with the cold water passage in the valve body to assure having cold syrup available for being dispensed when the syrup valve is opened. The cold water system of this modification is generally the same as that of the FIGS. 1–5 system except for the valve member, valve seat, nozzle and syrup system, and the same reference characters as used in FIGS. 1–5 are used in FIGS. 6–11 to designate similar parts.

In the FIGS. 6–11 valve, the port 21 is at a higher level than in the FIGS. 1–5 valve and and communicates with an outlet chamber 91. A valve seat 93 extends up in this chamber. The lower end of the valve plunger 95 is engageable with this seat. The passage 97 in the seat is in communication via a passage 99 with an annular space 101 in the valve body, this space being in communication via openings such as indicated at 103 with a cup-shaped diffuser 105 secured at its rim 107 in a mixing nozzle 109 extending down from the valve body. The diffuser has openings at 111 for exit of water therefrom into the nozzle.

Extending down centrally in the diffuser is what is called a syrup stem 113 having holes at 114 for delivering syrup into the nozzle 109 for mixing with the cold water exiting from the diffuser to constitute a drink, the mixture flowing down through and out of the nozzle into the cup 27. Syrup is adapted to be delivered to the syrup stem 113 from a suitable supply of syrup under pressure via a syrup passage generally designated 115 in the valve body under control of a syrup valve 117. Flow control means indicated generally at 119 is provided in the syrup passage upstream from the valve 117. This syrup flow control means, which is located alongside the water flow control means 63, is similar to the latter in comprising inner and outer telescoping tubular members or cylinders 121 and 123 in a chamber 125 in the valve body, a plunger 127 threaded in the body at 129 and a spring 131 between the plunger and the upper face of an annular flange 133 in the inner tubular member or cylinder 121, the latter having a ported disc 135 at the bottom of the flange. The syrup passage has an inlet portion 137 extending to the bottom of chamber 125. The outer tubular member or cylinder 123, which is seated in fixed relation in chamber 125, has openings as indicated at 139 at its upper end to a continuation 141 of the syrup passage which extends to a valve seat chamber 143 in the valve body. In this chamber is a valve seat 145 engageable at its upper end by the lower end of plunger 147 of the syrup valve 117, which is a solenoid valve. The passage 149 in the seat is in communication via a passage 151 with the syrup stem 113.

The outer tubular member or cylinder 123 of the syrup flow control 119 and chamber 125 in which it is seated are formed to provide an annular space 153 all around the member 123. A short inclined passage or port 155 connects the annular space 157 around the outer tubular member **65*a* of the water flow control 63 and the annular space 153 around member 123. Thus, cold water after flowing through the first space 157 around the cylinder 65*a* of the water flow control 63 flows through passage 155 to the second space 153 around the cylinder 123 of the syrup flow control 119**. The valve body *7a* is formed to provide a partition 159 (see FIG. 10) alongside the passage 155, and the water flows around the annular space 153 (counterclockwise as viewed in FIG. 10) to this partition and then out of space 153 via an exit passage 161 to the passage 31 for return to the line 3. Thus, provision is made for flow of chilled water in heat-exchange relation with the syrup passage to assure having cold syrup available for being dispensed when the syrup valve is opened.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for dispensing cold drinks comprising:

a line for supplying cold water for drinks adapted for continuous flow of water therethrough;

a valve for dispensing water from said supply line, said valve comprising a valve body having an inlet interconnected with said line at a first point along said line, an outlet for delivery of water from the valve body into a cup, a delivery passage in the body for delivery of water from the inlet to the outlet, a valve seat in the body adjacent the outlet, and a valve member associated with the body movable between a closed position engaging the seat blocking flow of water through the outlet and an open position for flow of water through the outlet; and a system for maintaining a continuous flow of the cold water through said delivery passage and back to said line when the valve member is closed to assure having cold water on tap for being dispensed when the valve member is opened, comprising a return passage in the valve body interconnected with the delivery passage downstream from the inlet and upstream from but adjacent the valve seat and a return connection from said return passage to said supply line at a second point along said line downstream from said first point, and means for causing a pressure differential in the water between said first and second points such that, when the valve member is closed, cold water flows continuously from said first point along said line to the inlet, through said delivery passage, through said return passage and through said return connection back to the line at said second point along said line.

2. Apparatus as set forth in claim 1 having a flow control in said delivery passage upstream from the valve seat, said return passage being interconnected with said delivery passage downstream from said flow control.

3. Apparatus as set forth in claim 2 having a check valve in said return passage in the valve body for preventing flow of liquid from said second point along the line back through said return passage to said delivery passage when the valve is open.

4. Apparatus as set forth in claim 3 wherein said means for causing the pressure differential comprises a Venturi in said supply line at said second point, said return connection being in communication with the Venturi throat.

5. Apparatus as set forth in claim 1 wherein the valve body further has a syrup passage for flow of syrup for a drink from a syrup supply to the outlet for mixing with cold water flowing through the outlet, and a syrup valve for said syrup passage, said syrup passage being in heat-exchange relation with said cold water flow system in said valve body to assure having cold syrup available for being dispensed when the syrup valve is opened.

6. Apparatus as set forth in claim 5 having a flow control in the syrup passage in heat-exchange relation with said cold water flow system.

7. Apparatus as set forth in claim 5 having a water flow control in said delivery passage upstream from the valve seat, and a syrup flow control in the syrup passage, water flowing from the water flow control in heat-exchange relation with the syrup flow control and then to said return passage.

8. Apparatus as set forth in claim 7 wherein the water flow control and syrup flow control are side-by-side in the valve body.

9. Apparatus as set forth in claim 8 wherein the valve body has a first chamber for the water flow control and a second chamber alongside the first, with a first space around the water flow control in the first chamber through which water flows from the water flow control and a second space around the syrup flow control in the second chamber, said body having a port interconnecting said spaces, and said exit passage from said second space to the return passage.

10. Apparatus as set forth in claim 9 wherein the syrup flow control comprises an outer cylinder fixed in said second chamber with said second space extending around said outer cylinder, and an inner cylinder slidable in the outer cylinder, and a partition for said second space between said port where the water enters said space and said exit passage whereby water flows through said second space around said outer cylinder and exits from said second space through said exit passage.

* * * * *